US008963909B2

(12) United States Patent
Choi

(10) Patent No.: US 8,963,909 B2
(45) Date of Patent: Feb. 24, 2015

(54) DATA DRIVING METHOD FOR DRIVING DISPLAY PANEL, DATA DRIVING CIRCUIT FOR PERFORMING THE SAME, AND DISPLAY APPARATUS HAVING THE DATA DRIVING CIRCUIT

(75) Inventor: Young-Hee Choi, Cheonan-si (KR)

(73) Assignee: Samsung Display Co., Ltd., Yongin (KR)

( * ) Notice: Subject to any disclaimer, the term of this patent is extended or adjusted under 35 U.S.C. 154(b) by 1192 days.

(21) Appl. No.: 12/421,403

(22) Filed: Apr. 9, 2009

(65) Prior Publication Data

US 2010/0033472 A1 Feb. 11, 2010

(30) Foreign Application Priority Data

Aug. 8, 2008 (KR) ..... 10-2008-0077819

(51) Int. Cl.
*G09G 5/00* (2006.01)
*G09G 3/36* (2006.01)

(52) U.S. Cl.
CPC ..... *G09G 3/3688* (2013.01); *G09G 3/3696* (2013.01); *G09G 2310/027* (2013.01); *G09G 2330/02* (2013.01); *G09G 2330/04* (2013.01)
USPC ..... 345/213

(58) Field of Classification Search
CPC ..... G09G 3/3688; G09G 3/3696; G09G 2310/027
USPC ..... 345/98–100, 213
See application file for complete search history.

(56) References Cited

FOREIGN PATENT DOCUMENTS

| | | | |
|---|---|---|---|
| JP | 2004302420 | | 10/2004 |
| JP | 2006267313 | | 10/2006 |
| KR | 1999-0056667 | * | 7/1999 |
| KR | 19990056667 | | 7/1999 |
| KR | 10-2006-0128447 | | 12/2006 |
| KR | 10-2007-0063635 | * | 6/2007 |
| KR | 10-2007-0068787 | | 7/2007 |
| KR | 10-2008-0064930 | | 7/2008 |

* cited by examiner

*Primary Examiner* — Dennis Joseph
(74) *Attorney, Agent, or Firm* — H.C. Park & Associates, PLC

(57) ABSTRACT

In a data driving method for driving a display panel, a data driving circuit, and a display apparatus, the data driving method includes receiving a digital driving voltage and an analog driving voltage. The analog driving voltage is switched, after the digital driving voltage is received and a specific driving time elapses. A digital data signal is converted to an analog data signal using the analog driving voltage. The analog data signal is output to a data line of the display panel.

19 Claims, 4 Drawing Sheets

DATA DRIVING METHOD FOR DRIVING DISPLAY PANEL, DATA DRIVING CIRCUIT FOR PERFORMING THE SAME, AND DISPLAY APPARATUS HAVING THE DATA DRIVING CIRCUIT

CROSS REFERENCE TO RELATED APPLICATION

This application claims priority from and the benefit of Korean Patent Application No. 10-2008-0077819, filed on Aug. 8, 2008, which is hereby incorporated by reference for all purposes as if fully set forth herein.

BACKGROUND OF THE INVENTION

1. Field of the Invention

The present invention relates to a data driving method for driving a display panel, a data driving circuit for performing the data driving method, and a display apparatus having the data driving circuit.

2. Discussion of the Background

Generally, a liquid crystal display (LCD) apparatus includes a liquid crystal panel and a driving apparatus to drive the liquid crystal panel. The liquid crystal panel includes an array substrate, an upper substrate, and a liquid crystal layer disposed between the array substrate and the upper substrate. The array substrate includes a plurality of data lines and gate lines that cross each other, and a plurality of pixels defined by the data lines and gate lines.

The driving apparatus includes a data driving circuit, a gate driving circuit, and a timing control part. The data driving circuit converts a data signal input from an external graphic device to an analog-type data signal and outputs the analog data signal to the data line. The gate driving circuit outputs a gate signal to activate the gate line corresponding to the data signal output to the data line. The timing control part controls the data driving circuit and the gate driving circuit.

The data driving circuit includes a plurality of data driving chips that divide the plurality of data lines into units to process data. Each data driving chip may output the input data signal to a corresponding data line via a data processing stage that includes several steps. The data driving chips each include digital circuits and analog circuits. A digital driving voltage to drive the digital circuits and an analog driving voltage to drive the analog circuits are applied to the data driving chip.

However, the analog driving voltage is often applied to the data driving chip when the digital driving voltage is not applied, so the data driving chip may be damaged.

SUMMARY OF THE INVENTION

The present invention provides a data driving method for driving a display panel capable of sequentially applying a digital driving voltage, a data voltage, and an analog driving voltage to a driving apparatus.

The present invention also provides a data driving circuit for performing the data driving method.

The present invention also provides a display apparatus having the data driving circuit.

Additional features of the invention will be set forth in the description which follows, and in part will be apparent from the description, or may be learned by practice of the invention.

The present invention discloses a data driving method for driving the display panel including receiving a digital driving voltage and an analog driving voltage. The analog driving voltage is switched after the digital driving voltage is received and a specific driving time elapses. A digital data signal is converted to an analog data signal using the analog driving voltage. The analog data signal is output to a data line of the display panel.

The present invention also discloses a data driving circuit including a digital driving part receiving a digital data signal using a digital driving voltage, an analog driving part converting the digital data signal to an analog data signal using an analog driving voltage to output the analog data signal to a data line of a display panel, and a switching part providing the analog driving voltage to the analog driving part after the digital driving voltage is received and a specific driving time elapses.

The present invention also discloses a display apparatus including a display panel, a first voltage generating part, a second voltage generating part, a data driving circuit, and a timing control part. The display panel includes a pixel electrode connected to a data line and a gate line. The first voltage generating part generates a digital driving voltage and outputs the digital driving voltage. The second voltage generating part generates an analog driving voltage and outputs the analog driving voltage. The data driving circuit includes a digital driving part receiving a digital data signal using the digital driving voltage, an analog driving part converting the digital data signal to the analog data signal using an analog driving voltage and to output the analog data signal to the data line, and a switching part providing the analog driving voltage to the analog driving part after the digital driving voltage is received and a specific driving time elapses. The timing control part controls the data driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIG. 3 is a waveform diagram showing the order of a first digital driving voltage, an analog driving voltage, and a digital data signal when the data driving circuit in FIG. 2 is turned on.

DETAILED DESCRIPTION OF THE ILLUSTRATED EMBODIMENTS

Figure 1:
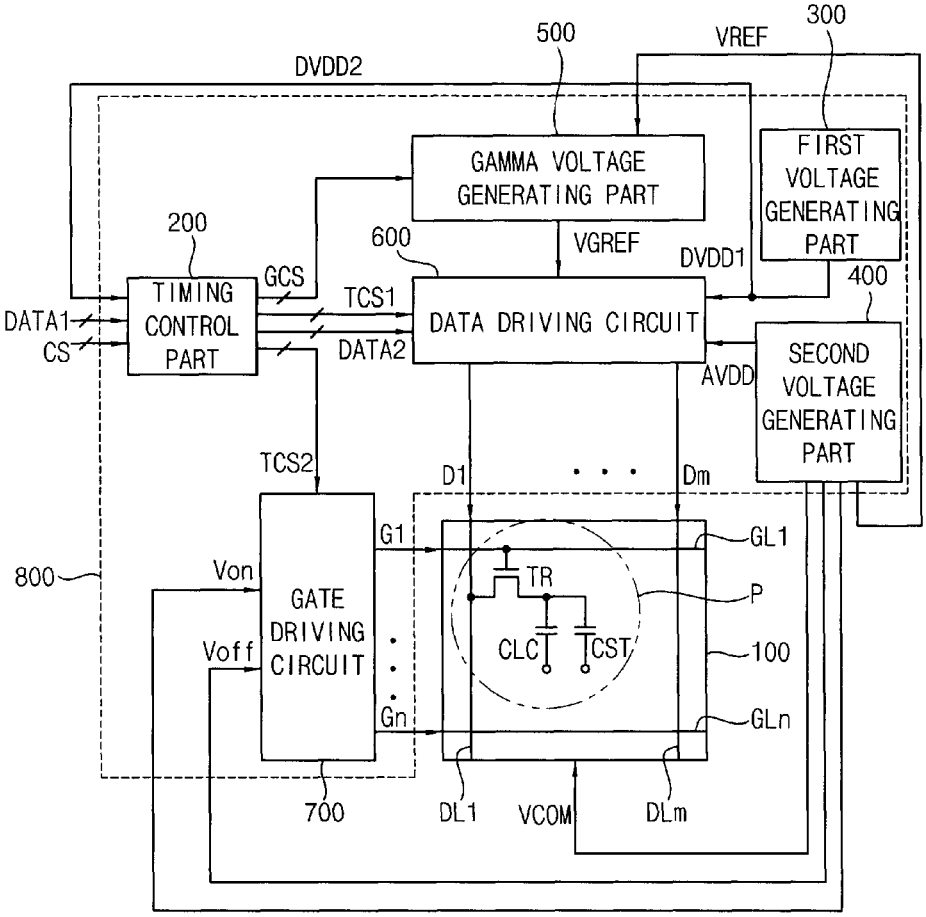
FIG. 1 is a block diagram showing a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to," or "coupled to" another element or layer, it can be directly on, connected to, or coupled to the other element or layer or intervening elements or layers may be present. In contrast, when an element is referred to as being "directly on," "directly connected to," or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers and/or sections should not be limited by these terms. These terms are only used to distinguish one element, component, region, layer, or section from another region, layer, or section.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be explained in detail with reference to the accompanying drawings.

FIG. 1 is a block diagram showing a display apparatus according to an exemplary embodiment of the present invention.

Referring to FIG. 1, the display apparatus includes a display panel 100 and a driving apparatus 800 to drive the display panel 100.

The display panel 100 includes a plurality of pixels P connected to a plurality of gate lines GL1, . . . , GLn and a plurality of data lines DL1, . . . , DLm. Each pixel P includes a thin-film transistor TR, a liquid crystal capacitor CLC, and a storage capacitor CST connected to the thin-film transistor TR.

The driving apparatus 800 includes a timing control part 200, a first voltage generating part 300, a second voltage generating part 400, a gamma voltage generating part 500, a data driving circuit 600, and a gate driving circuit 700. In this case, the first voltage generating part 300 may be a regulator and the second voltage generating part 400 may be a direct current-to-direct current (DC-to-DC) converter.

The timing control part 200 receives an input image data DATA1 and a control signal CS provided from a host such as an external graphics controller (not shown).

The timing control part 200 converts the input image data DATA1 to a digital type data signal DATA2 capable of driving the display panel 100, and provides the digital type data signal DATA2 to the data driving circuit 600.

The control signal CS may include a vertical synchronized signal VSYNC, a horizontal synchronized signal HSYNC, a main clock signal MCLK, and a data enable signal DE. The timing control part 200 generates a gamma control signal GCS and outputs the gamma control signal GCS to the gamma voltage generating part 500.

The timing control part 200 receives the control signal CS, and generates a first timing control signal TCS1 to control a driving timing of the data driving circuit 600 and a second timing control signal TCS2 to control a driving timing of the gate driving circuit 700.

The first timing control signal TCS 1 may include a horizontal start signal, a reverse signal, and an output enable signal. The second timing control signal TCS2 may include a vertical start signal, a gate clock signal, and the output enable signal. The first timing control signal TCS1 is output to the data driving circuit 600, and the second timing control signal TCS2 is output to the gate driving circuit 700.

Although not shown in the figures, the timing control part 200 may generate control signals to control timings of the first and second voltage generating parts 300 and 400, and may output the control signals to the first and second voltage generating parts 300 and 400, respectively.

The second voltage generating part 400 generates an analog driving voltage AVDD to drive analog circuits of the data driving circuit 600.

The first voltage generating part 300 generates a first digital driving voltage DVDD1 to drive digital circuits of the data driving circuit 600, and a second digital driving voltage DVDD2 to drive digital circuits of the timing control part 200.

The second voltage generating part 400 also generates a reference voltage VREF provided to the gamma voltage generating part 500, a gate on voltage Von and a gate off voltage Voff provided to the gate driving circuit 700, and a common voltage VCOM provided to the display panel 100.

The gamma voltage generating part 500 generates a plurality of gamma reference voltages VGREF based on the gamma control signal GCS provided from the timing control part 200, and outputs the plurality of gamma reference voltages VGREF to the data driving circuit 600.

Although not shown in the figures, the gamma voltage generating part 500 may include a resistor string having a plurality of resistors serially connected between a gamma power voltage and a ground power voltage, and may generate the gamma reference voltage VGREF by dividing a difference between a voltage applied to the gamma power voltage and a voltage applied to the ground power voltage.

The data driving circuit 600 converts the digital data signal DATA2 to an analog-type data signal based on the data control signal TCS 1 and the gamma reference voltage VGREF, and outputs the analog-type data signal to the data lines DL1, . . . , DLm. In this case, the data control signal TCS1 may include the horizontal start signal STH to start input of the digital data signal DATA2, a load signal TP to start output of the digital data signal DATA2, the reverse signal RVS to reverse a polarity of the analog data signal, and a data clock signal DCLK. The data driving circuit 600 mentioned above generally includes a plurality of data driving chips.

The gate driving circuit 700 sequentially outputs a plurality of gate signals G1, . . . , Gn to the gate lines GL1, . . . , GLn based on the gate control signal TCS2 and the gate on and gate off voltages Von and Voff. In this case, the gate control signal TCS2 may include the vertical start signal STV to start output of the gate on signal, the gate clock signal GCLK to control an output time of the gate on signal, and a gate output enable signal GOE to limit a pulse width of the gate on signal. The gate driving circuit 700 mentioned above includes a plurality of gate driving chips, but alternatively may be directly formed on the display panel 100 as an integrated circuit.

Figure 2:
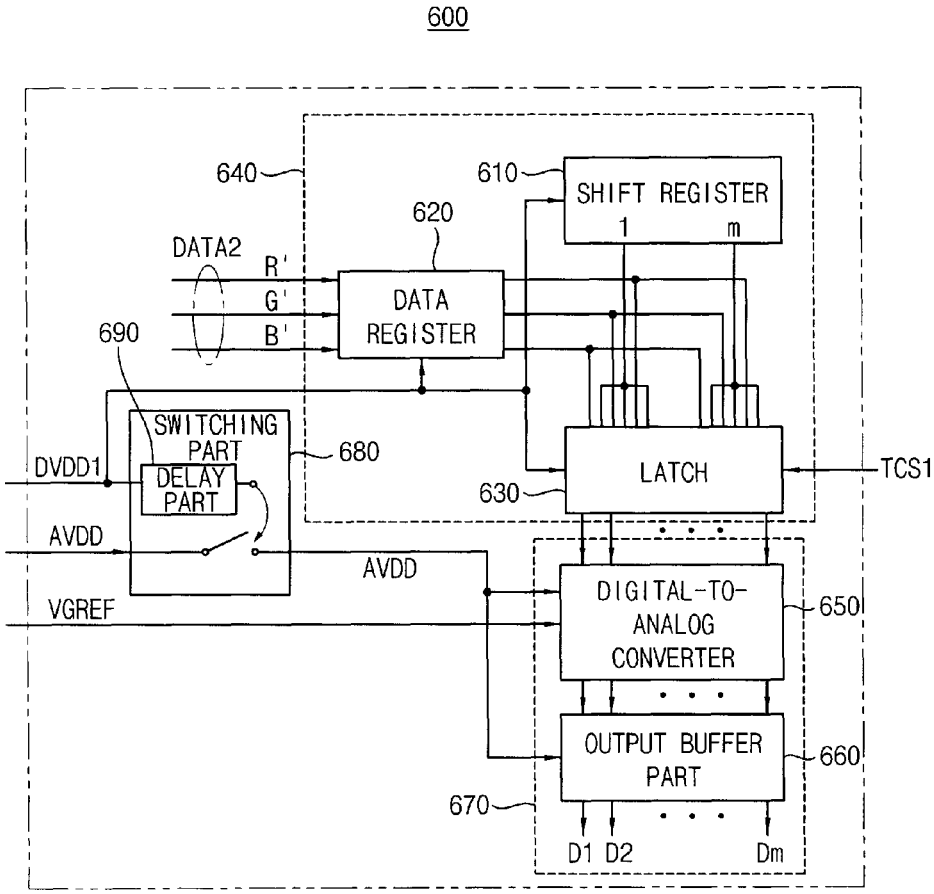
FIG. 2 is a block diagram showing the data driving circuit in FIG. 1.

FIG. 2 is a block diagram showing the data driving circuit 600 in FIG. 1.

Referring to FIG. 1 and FIG. 2, the data driving circuit 600 converts the digital data signal DATA2 transferred from the timing control part 200 to an analog-type data signal and outputs the analog-type data signal to the display panel 100.

For example, the data driving circuit 600 includes a digital driving part 640, an analog driving part 670, and a switching part 680.

The digital driving part 640 includes the digital circuits and receives the digital data signal DATA2. The digital driving part 640 is driven by the first digital driving voltage DVDD1.

The digital driving part 640 includes a shift register 610, a data register 620, and a latch 630.

The shift register 610 outputs a latch pulse to the latch 630.

The data register 620 sequentially applies the digital data signal DATA2, such as red, green, and blue data signals R, G, and B to the latch 630. The data register 620 outputs the red, green, and blue data signals R, G, and B to the latch 630 when the latch pulse is input from the shift register 610.

The latch 630 temporarily stores a channel unit of the red, green, and blue data signals R, G, and B, and latches the channel unit of the red, green, and blue data signals R, G, and B. When the first timing control signal TCS 1 is input, the latched channel unit of digital data signal DATA2 is output.

The analog driving part 670 includes the analog circuits, and converts the digital data signal DATA2 to the analog data signal. Thus, the analog driving part 670 is driven by the analog driving voltage AVDD.

The analog driving part 670 includes a digital-to-analog converter (DAC) 650 and an output buffer part 660.

The DAC 650 converts the latched digital data signal DATA2 output from the latch 630 to the analog-type data signals D1, D2, . . . , Dm based on the gamma reference voltage VGREFF, and outputs the analog-type data signals D1, D2, . . . , Dm.

The output buffer part 660 amplifies the data signal converted to the analog type and outputs the data signal. The analog-type data signals D1, D2, . . . , Dm are output to the data lines DL of the display panel 100.

The switching part 680 delays and switches the analog driving voltage AVDD, so that the first digital driving voltage DVDD1 is applied to the digital driving part 640 and then the analog driving voltage AVDD is applied to the analog driving part 670.

The switching part 680 includes a delay part 690.

The switching part 680 receives the first digital driving voltage DVDD1 and the analog driving voltage AVDD.

When the first digital driving voltage DVDD1 is received normally, the analog driving voltage AVDD is switched so that the analog driving voltage AVDD is applied to the analog driving part 670. In this case, the delay part 690 turns on the switching part 680 after a specific driving time. The specific driving time is a time when the digital driving part 640 is driven. For example, when the first digital driving voltage DVDD1 is received normally, the delay part 690 delays and blocks the analog driving voltage AVDD during the specific driving time. Then, after the specific driving time has elapsed, the delay part 690 makes the analog driving voltage AVDD pass through the delay part 690. In this case, the specific driving time may be between about 60 μs and about 100 μs.

However, when the first digital driving voltage DVDD1 is not applied due to abnormal operation of the first voltage generating part 300, the analog driving voltage AVDD is blocked so that the analog driving voltage AVDD is not applied to the analog driving part 670.

Figure 3:
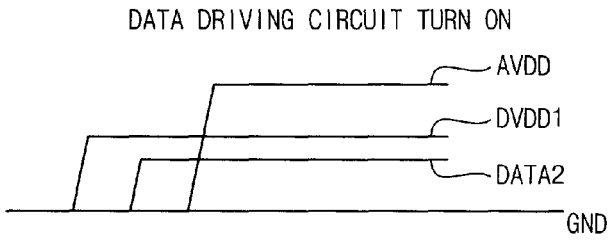

FIG. 3 is a waveform diagram showing the order of a first digital driving voltage DVDD1, an analog driving voltage AVDD, and a digital data signal DATA2 when the data driving circuit in FIG. 2 is turned on.

Referring to FIG. 2 and FIG. 3, when the data driving circuit 600 is turned on, the first digital driving voltage DVDD1 is applied so that the digital driving part 640 is driven.

In this case, the digital driving part 640 receives the digital data signal DATA2.

The switching part 680 receives the first digital driving voltage DVDD1.

When the first digital driving voltage DVDD1 is applied normally, the delay part 690 blocks the analog driving voltage AVDD during the specific driving time, and then after the specific driving time, the delay part 690 makes the analog driving voltage AVDD pass through the delay part 690.

Then, the analog driving voltage AVDD drives the analog driving part 670, so that the digital data signal DATA2 is converted to the analog-type data signals D1, D2, . . . , Dm.

Thus, the first digital driving voltage DVDD1, the analog driving voltage AVDD, and the digital data signal DATA2 are applied in order.

When the first digital driving voltage DVDD1 is not applied due to the abnormal operation of the first voltage generating part 300, the analog driving voltage AVDD is blocked so that the analog driving voltage AVDD is not applied to the analog driving part 670. For example, when the analog driving voltage AVDD is applied to the data driving circuit 600 and due to the abnormal operation of the first voltage generating part 300, the first digital driving voltage DVDD1 is not applied, the switching part 680 blocks application of the analog driving voltage AVDD.

Thus, damage to the driving chip of the data driving circuit 600 may be prevented.

Figure 4A:
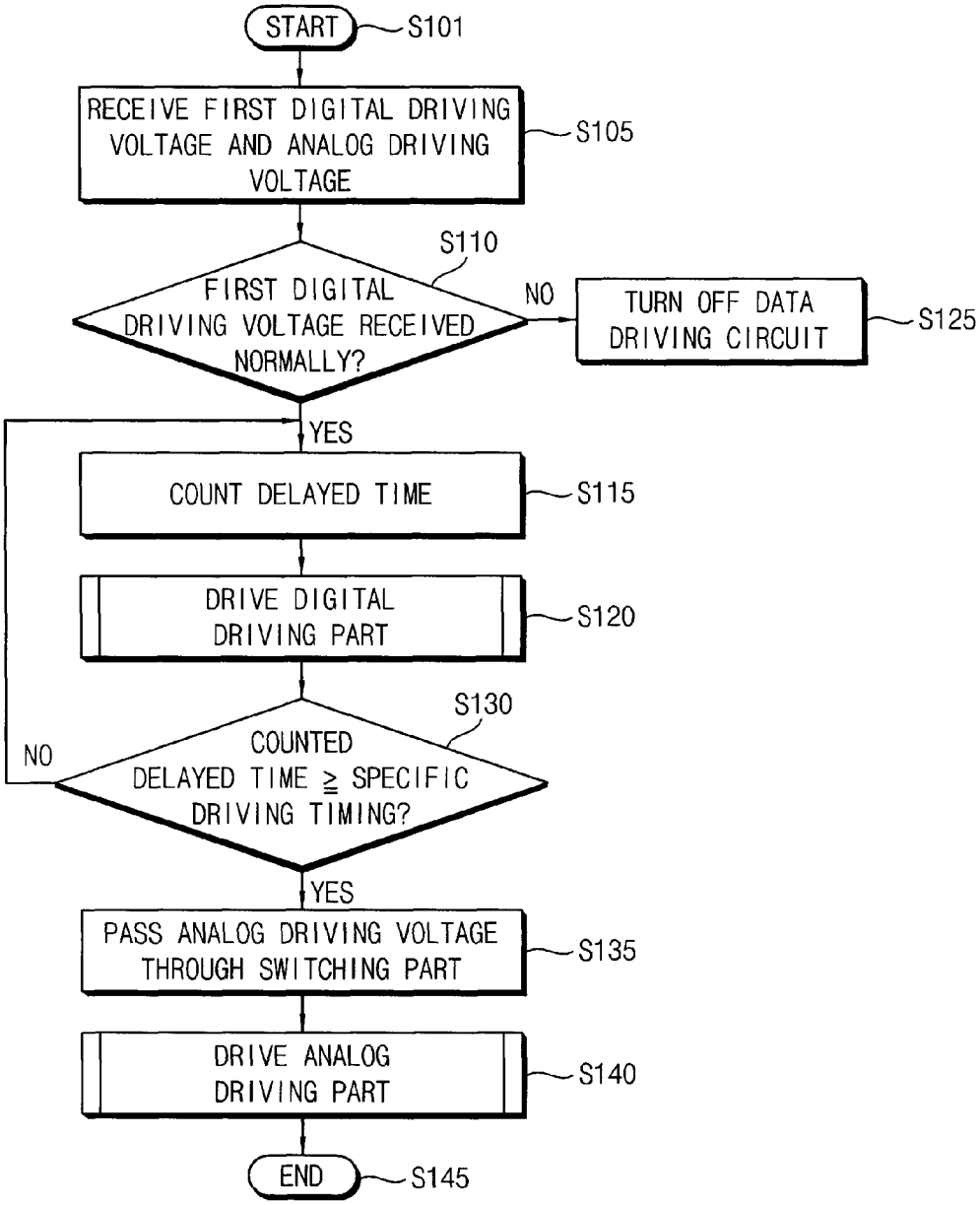
FIG. 4A, FIG. 4B, and FIG. 4C are flowcharts showing a driving method of the data driving circuit in FIG. 2.
Figure 4B:
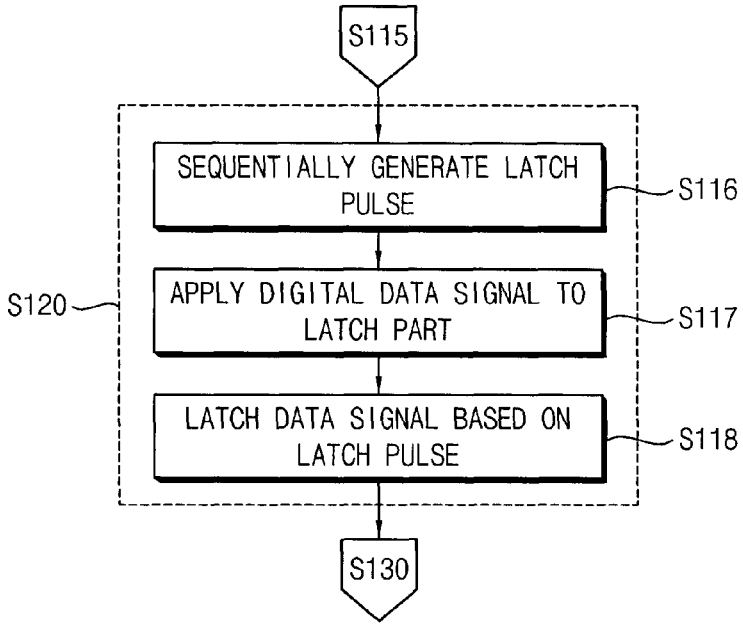
Figure 4C:
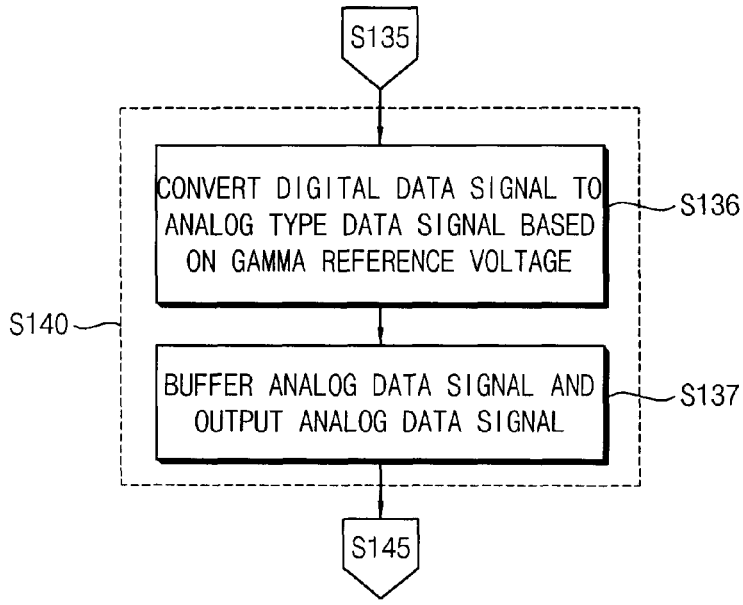

FIG. 4A, FIG. 4B, and FIG. 4C are flowcharts showing a driving method of the data driving circuit in FIG. 2.

Referring to FIG. 1, FIG. 2, FIG. 3, and FIG. 4A, the data driving circuit 600 is turned on to start driving (S101). Then, the data driving circuit 600 receives the first digital driving voltage DVDD1 output from the first voltage generating part 300 and the analog driving voltage AVDD output from the second voltage generating part 400 (S105).

The switching part 680 determines whether or not the first digital driving voltage DVDD1 is received normally (S110).

When the first digital driving voltage DVDD1 is received normally, the delay part 690 of the switching part 680 counts a delayed time (S115).

The first digital driving voltage DVDD1 drives the digital driving part 640 while the delay part 690 counts the delayed time (S120).

When the first digital driving voltage DVDD1 is not applied due to abnormal operation of the first voltage generating part 300, the switching part 680 turns off the data driving circuit 600 (S125).

While the first digital driving voltage DVDD1 drives the digital driving part 640, it is determined whether the counted delayed time is greater than or equal to a specific driving time (S130).

When the counted delayed time is greater than or equal to the specific driving time, the switching part 680 blocking the analog driving voltage AVDD makes the analog driving voltage AVDD pass through the switching part 680 (S135).

When the counted delayed time is less than the specific driving time at (S130), the delayed time is continuously counted until the counted delayed time is greater than or equal to the specific driving time (S115), and the first digital driving voltage DVDD1 drives the digital driving part 640 (S120).

The analog driving voltage AVDD passing through the switching part 680 drives the analog driving part 670 (S140).

Referring to FIG. 1, FIG. 2, FIG. 3, and FIG. 4B, the first digital driving voltage DVDD1 drives the digital driving part 640 as follows.

The shift register 610 is driven by the first digital driving voltage DVDD1 to generate sequential latch pulses (S116). Then, the data register 620 is driven by the first digital driving voltage DVDD1 to sequentially apply the digital data signal DATA2 to the latch 630 (S117). Then, the latch 630 is driven by the first digital driving voltage DVDD1, temporarily stores the digital data signal DATA2, which is synchronized with the latch pulse and is sequentially output, and latches the digital data signal DATA2.

Referring to FIG. 1, FIG. 2, FIG. 3, and FIG. 4C, the analog driving voltage AVDD drives by the analog driving part 670 as follows.

The DAC 650 is driven by the analog driving voltage AVDD and converts the digital data signal DATA2 latched to the analog data signal D1, D2, . . . , Dm based on the gamma reference voltage VGREF (S136). Then, the output buffer part 660 is driven by the analog driving voltage AVDD to buffer the analog data signal D1, D2, . . . , Dm and output the analog signal D1, D2, . . . , Dm to the data lines DL1, DL2, . . . , DLm of the display panel 100 (S137).

According to exemplary embodiments of the present invention, when a digital driving voltage is applied normally, an analog driving voltage is applied after the digital driving voltage. In addition, when the digital driving voltage is not applied, the analog driving voltage may be blocked. Thus, the abnormal operation of a second voltage generating part may be prevented so that damage to a driving chip may be prevented.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A data driving method for driving a display panel, comprising:

receiving a digital driving voltage and an analog driving voltage;

counting a delay time in response to receiving the digital driving voltage;

comparing the counted delay time with a preset threshold driving time;

blocking the analog driving voltage in response to the delay time being less than the preset threshold driving time;

passing the analog driving voltage in response to the delay time being the same as or greater than the preset threshold driving time;

converting a digital data signal to an analog data signal using the passed analog driving voltage; and outputting the analog data signal to a data line of the display panel wherein the preset threshold driving time is in the range of 60 us to 100 us.

2. The data driving method of claim 1, further comprising:

generating a latch pulse using the digital driving voltage; and temporarily storing the digital data signal, the digital data signal being synchronized with the latch pulse.

3. The data driving method of claim 2, wherein the digital data signal is converted to the analog data signal using a gamma reference voltage.

4. The data driving method of claim 3, wherein the analog driving voltage is switched after the digital data signal is temporarily stored.

5. The data driving method of claim 1, further comprising blocking an output of the analog driving voltage in response to determining that the digital driving voltage is not received.

6. The data driving method of claim 1, wherein the digital driving voltage is generated independently from the analog driving voltage.

7. A data driving circuit, comprising:

a switching part configured to count a delay time in response to receiving a digital driving voltage, configured to block an analog driving voltage in response to the counted delay time being less than a preset threshold driving time, and configured to pass the analog driving voltage to the analog driving part in response to the delay time being greater than or equal to the preset threshold driving time;

a digital driving part configured to receive a digital data signal using the digital driving voltage; and an analog driving part configured to convert the digital data signal to an analog data signal using the passed analog driving voltage and to output the analog data signal to a data line of a display panel wherein the preset threshold driving time is in the range of 60 us to 100 us.

8. The data driving circuit of claim 7, wherein the digital driving part comprises:

a shift register configured to generate a latch pulse; and a latch synchronized with the latch pulse to temporarily store the digital data signal.

9. The data driving circuit of claim 8, wherein the analog driving part comprises:

a digital-to-analog converter (DAC) configured to convert the digital data signal output from the latch to the analog data signal using a gamma reference voltage; and an output buffer part configured to output the analog data signal to the data line.

10. The data driving circuit of claim 7, wherein the digital driving part is driven during the preset threshold driving time.

11. The data driving circuit of claim 7, wherein the switching part comprises a delay part configured to delay the analog driving voltage until the preset threshold driving time elapses.

12. The data driving circuit of claim 7, wherein the switching part is configured to block an output of the analog driving voltage in response to determining that the digital driving voltage is not received.

13. A display apparatus, comprising:

a display panel comprising a pixel electrode connected to a data line and a gate line;

a first voltage generating part configured to generate a digital driving voltage and output the digital driving voltage;

a second voltage generating part configured to generate an analog driving voltage and output the analog driving voltage;

a data driving circuit comprising:

a switching part configured to count a delay time in response to receiving the outputted digital driving voltage, configured to block the outputted analog driving voltage in response to the delay time being less than a preset threshold driving time, and configured to pass the outputted analog driving voltage in response to the delay time being the same as or greater than the preset threshold driving time;

a digital driving part configured to receive a digital data signal using the digital driving voltage; and an analog driving part configured to convert the digital data signal to an analog data signal using the passed analog driving voltage and to output the analog data signal to the data line; and a timing control part to controlling the data driving circuit, wherein the preset threshold driving time is in the range of 60 us to 100 us.

14. The display apparatus of claim 13, further comprising:

a gamma voltage generating part configured to generate a gamma reference voltage and outputting the gamma reference voltage; and a gate driving circuit sequentially configured to output a gate signal to the gate lines.

15. The display apparatus of claim 13, wherein the digital driving part comprises:

a shift register configured to generate a latch pulse; and a latch synchronized with the latch pulse to temporarily store the digital data signal.

16. The display apparatus of claim 15, wherein the analog driving part comprises:

a digital-to-analog converter (DAC) configured to convert the digital data signal output from the latch to the analog data signal using a gamma reference voltage; and an output buffer part configured to output the analog data signal to the data line of the display panel.

17. The display apparatus of claim 13, wherein the digital driving part is driven during the preset threshold driving time.

18. The display apparatus of claim 13, wherein the switching part comprises a delay part configured to delay the analog driving voltage until the preset threshold driving time elapses.

19. The display apparatus of claim 13, wherein the switching part configured to block an output of the analog driving voltage in response to determining the digital driving voltage is not received.

* * * * *